US009616464B1

(12) United States Patent
Currey

(10) Patent No.: US 9,616,464 B1
(45) Date of Patent: Apr. 11, 2017

(54) SHAFT ASSEMBLY FOR A MECHANICAL BUCKET

(71) Applicant: Albert Ben Currey, Phoenix, AZ (US)

(72) Inventor: Albert Ben Currey, Phoenix, AZ (US)

( * ) Notice: Subject to any disclaimer, the term of this patent is extended or adjusted under 35 U.S.C. 154(b) by 382 days.

(21) Appl. No.: 14/029,236

(22) Filed: Sep. 17, 2013

(51) Int. Cl.
*B01F 7/00* (2006.01)
*B07B 1/00* (2006.01)

(52) U.S. Cl.
CPC ..... *B07B 1/00* (2013.01)

(58) Field of Classification Search
CPC ..... B01F 7/001
USPC ..... 366/82, 315, 319
See application file for complete search history.

(56) References Cited

U.S. PATENT DOCUMENTS 3,239,882 A * 3/1966 Yokana ..... B29C 47/60 366/82
2007/0177451 A1* 8/2007 Benjamin ..... B01F 7/001 366/82

* cited by examiner

*Primary Examiner* — David Sorkin
(74) *Attorney, Agent, or Firm* — Schmeiser, Olsen & Watts LLP

(57) ABSTRACT

A shaft assembly for use with a mechanical bucket is provided. The shaft assembly includes a shaft having a first end and an opposing second end and a mounting portion extending between the first end and the second end. Further the shaft assembly includes a plurality of agitating discs, a plurality of first spacer discs and a plurality of second spacer discs, each disc having an aperture corresponding to the mounting portion of the shaft. The plurality of agitating discs, the plurality of first spacer discs and the plurality of second spacer discs are slid onto the shaft in a repeating disc order with the apertures engaging the mounting portion of the shaft and the discs compressed together. The disc closet to the first end of the shaft and the disc closest to the second end of the shaft are coupled to the shaft.

13 Claims, 7 Drawing Sheets

SHAFT ASSEMBLY FOR A MECHANICAL BUCKET

BACKGROUND OF THE INVENTION

Technical Field

This invention relates generally to a shaft assembly for a mechanical bucket and more particularly to a shaft assembly and method of making the same for use with a mechanical bucket.

State of the Art

The separation of smaller material from larger material is common in instances such as excavation wherein the smaller material is desired at one location and the larger material is desired to be at a second location. This is commonly performed in a process that requires several steps to complete.

For example, a vehicle such as, but not limited to a hydraulic excavator, backhoe or loader applications, may use a bucket or other device to collect a particular amount of material. The material may be deposited into a separating device, such as a screen or disc screen separator. The smaller material is separated from the larger material. The smaller material may then be transported to a first location and the larger material may be transported to a second location. There are several limitations to these common or conventional forms of separating smaller material from larger material.

One limitation includes having multiple pieces of equipment to perform the separation of the material. A vehicle is required to collect the material. A separating device then separates the smaller material from the larger material. A vehicle may be employed to deliver the smaller material to a first location and another vehicle may be employed to deliver the larger material to second location. This creates a time consuming process of separating material.

Mechanical buckets have been employed to screen the material in the place of the multistep and multi-equipment systems discussed above. The mechanical bucket is limited in the shaft assemblies that are utilized to separate the material. Conventional shaft assemblies have several parts that are welded to a shaft. The making of these shaft assemblies are time consuming and prevent reuse of the shaft.

DISCLOSURE OF THE INVENTION

The present invention relates to a shaft assembly for a mechanical bucket and a method of making the same.

In an embodiment, a shaft assembly for use with a mechanical bucket comprises a shaft having a first end and an opposing second end and a mounting portion extending between the first end and the second end; a plurality of agitating discs, each agitating spacer disc having an aperture corresponding to the mounting portion of the shaft; a plurality of first spacer discs, each first spacer disc having an aperture corresponding to the mounting portion of the shaft; and a plurality of second spacer discs, each second spacer disc having an aperture corresponding to the mounting portion of the shaft. The plurality of agitating discs, the plurality of first spacer discs and the plurality of second spacer discs slid onto the shaft in a repeating disc order with the apertures engaging the mounting portion of the shaft and the discs compressed together. Further, the disc closet to the first end of the shaft and the disc closest to the second end of the shaft are coupled to the shaft.

In another embodiment, a shaft assembly for use with a mechanical bucket comprises a shaft having a first end and an opposing second end and a mounting portion extending between the first end and the second end; a plurality of agitating discs, each agitating spacer disc having an aperture corresponding to the mounting portion of the shaft; a plurality of spacer discs, each spacer disc having an aperture corresponding to the mounting portion of the shaft; a reference disc having an aperture corresponding to the mounting portion of the shaft, wherein the reference disc is slid onto the shaft and located adjacent the first end of the shaft; and an end disc having an aperture corresponding to the mounting portion of the shaft, wherein the reference disc is slid onto the shaft and located adjacent the first end of the shaft. The plurality of agitating discs and the plurality of spacer discs are slid onto the shaft in a repeating disc order with the apertures engaging the mounting portion of the shaft and the discs compressed together between the reference disc and the end disc in an axial direction. Further, the reference disc and the end disc are the only discs removably secured to the shaft.

In yet another embodiment, a method of forming a shaft assembly for use with a mechanical bucket comprises providing a shaft with a first end having a circular shape and an opposing second end having a circular shape and a mounting portion between the first end and second end; coupling a reference disc to the mounting portion of the shaft adjacent the first end; sliding a plurality of agitating discs, first spacer discs and second spacer discs onto the shaft in a repeating disc order; compressing the discs on the shaft together; and coupling end disc, the end disc being the disc closest to the second end of the shaft, to the shaft while the discs are compressed together.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a material directing device for use with a mechanical bucket.

Figure 1:
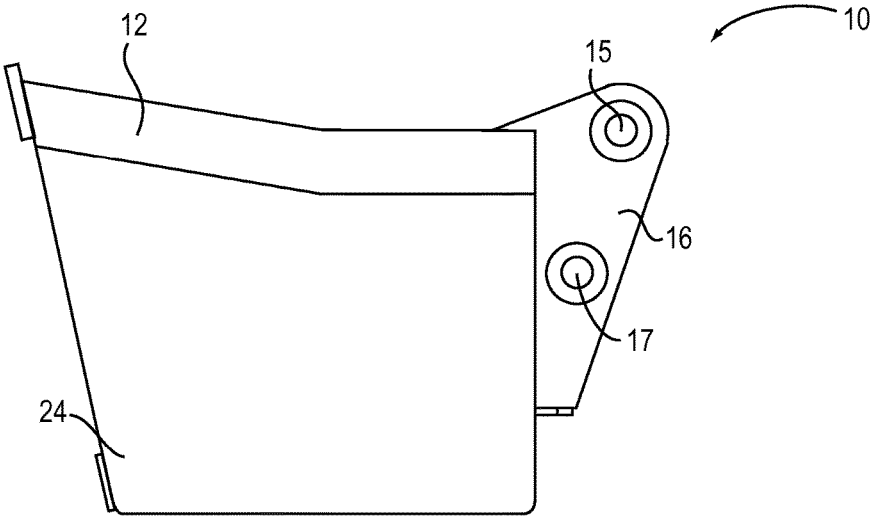
FIG. 1 is a side view a mechanical bucket.
Figure 2:
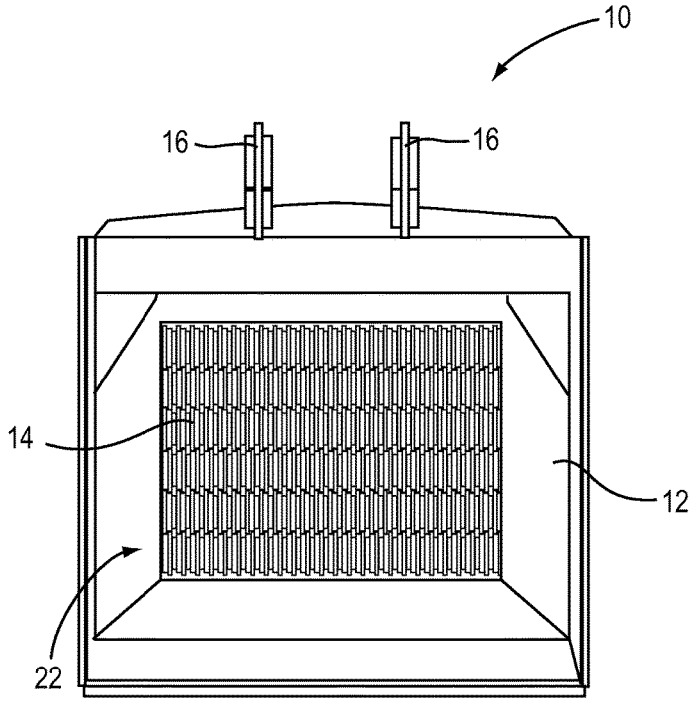
FIG. 2 is a top view of a mechanical bucket.
Figure 3:
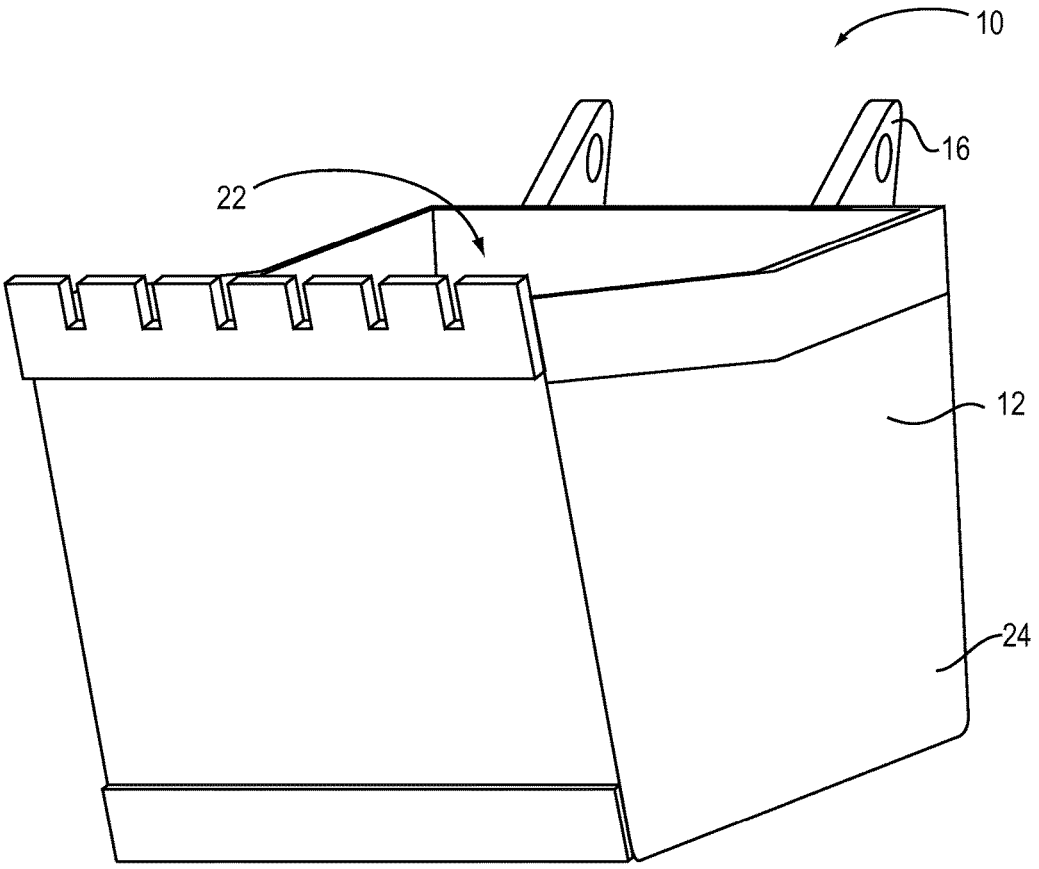
FIG. 3 is a perspective view a mechanical bucket.

Referring to the drawings, FIGS. 1-3, depict a mechanical bucket 10 with a material directive device 30 in accordance with particular embodiments. The mechanical bucket 10 includes a bucket 12, and an agitator 14. The disc assembly is coupled to a bottom portion 24 of the bucket 12. The bucket 12 further includes mounting ears 16. The mounting ears 16 comprise mounting apertures 15, 17 for mounting to a vehicle, such as, but not limited to, a hydraulic excavator and/or backhoe.

The bucket 12 includes an opening 22 for receiving material within the bucket 12. The material rests on the agitator 14 without any substantial portion of the material falling through the agitator 14 when the agitator 14 is deactivated. Upon activation of the agitator 14, the agitator 14 is adapted to allow smaller material to be separated from larger material. The activation of the agitator 14 agitates the material and allows smaller material to pass through the agitator 14 while the larger material remains within the bucket 12, resting on the agitator 14. The mechanical bucket 10 may also operate to crush larger material in order to process them into a small enough material to fit through the screening spaces of the agitator 14.

Figure 4:
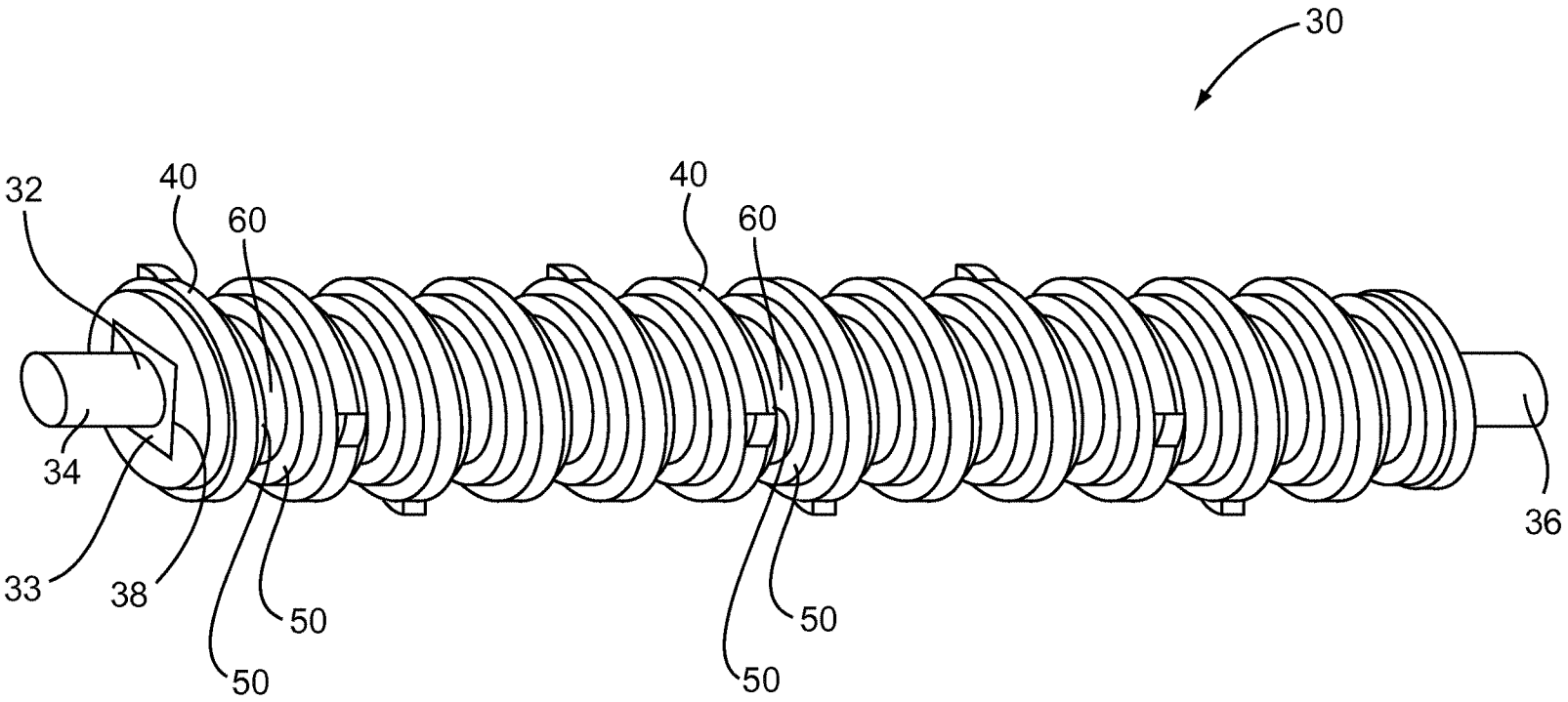
FIG. 4 is a perspective view of a shaft assembly for a mechanical bucket.

Referring to FIG. 4, the agitator 14 comprises a plurality of shaft assemblies 30. Each shaft assembly 30 comprises a plurality of agitating discs 40, a plurality of first spacer discs 50 and a plurality of second spacer discs 60, all coupled onto a shaft 32.

Figure 5:
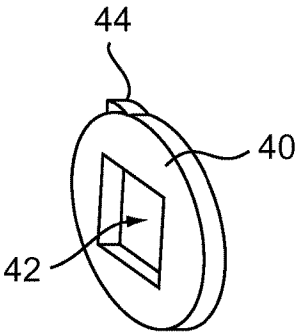
FIG. 5 is a perspective view of an agitating disc of a shaft assembly for a mechanical bucket.
Figure 9:
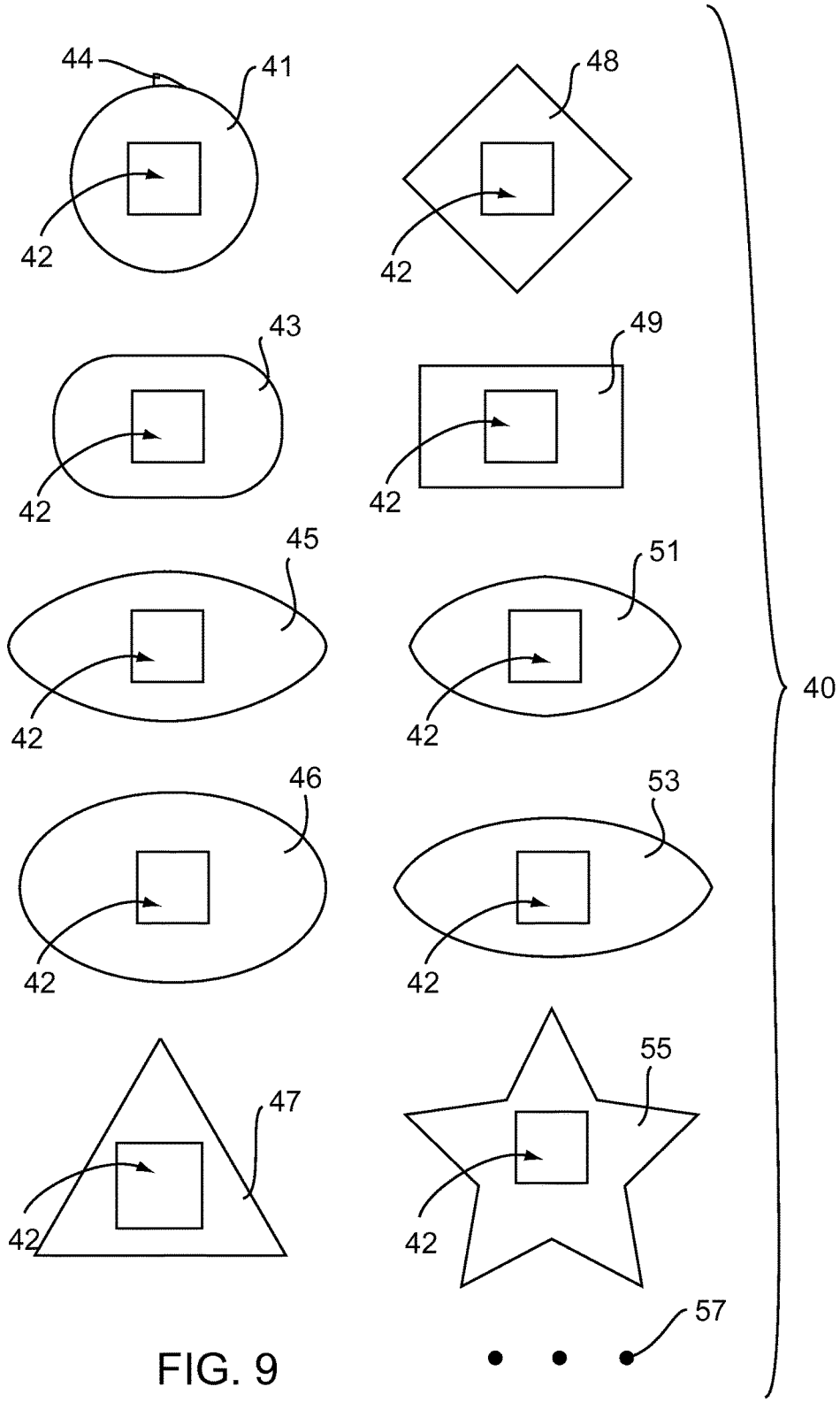
FIG. 9 is a side view of embodiments of an agitating disc.

As shown in FIG. 5 an agitating disc 40 comprises an aperture 42, wherein the aperture 42 corresponds to the shaft 32. In particular embodiments, the agitating disc 40 comprises a tooth 44, wherein the tooth 44 operates to agitate and in particular instances to crush material within the bucket 30. With additional reference to FIG. 9 of the drawings, various shapes and types of agitating discs 40 may be used as part of the shaft assembly. For example and without limitation, the agitating disc 40 may include a round disc 41 with a tooth 44; an oval disc 43, a football shaped disc 45, an elliptical shape 46, a triangular shape 47, a square shape 48, rectangular shape 49, an ogive 51, a rounded ogive 53, a star 55, and any other shape usable within an agitator 14.

Figure 6:
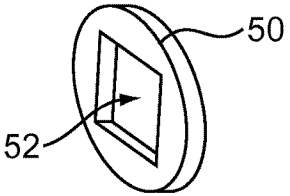
FIG. 6 is a perspective view of a first spacer disc of a shaft assembly for a mechanical bucket.
Figure 7:
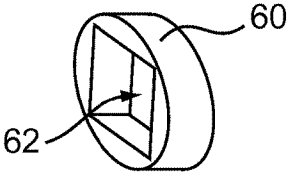
FIG. 7 is a perspective view of a second spacer disc of a shaft assembly for a mechanical bucket.

Referring to FIGS. 6 and 7, a first spacer disc 50 comprises an aperture 52 and a second spacer disc 60 comprises an aperture 62. Each the aperture 52 and the aperture 62 correspond to the shaft 32, wherein the shaft 32 extends through and operatively engages the apertures 52 and 62 of the first spacer disc 50 and second spacer disc 60 respectively. While shown as circular discs, other embodiments may include spacer discs of varying types of shapes.

The width of the plurality of agitating discs 40, the plurality of first spacer discs 50 and the plurality of second spacer discs 60 may vary depending on the screening size required by a user. Further, while it is shown that two spacers are used, it is contemplated that only one spacer may be used, and further in some embodiments, the agitating discs 50 may include a protrusion on one or both sides to set the spacing between adjacent agitating discs 50.

Figure 8:
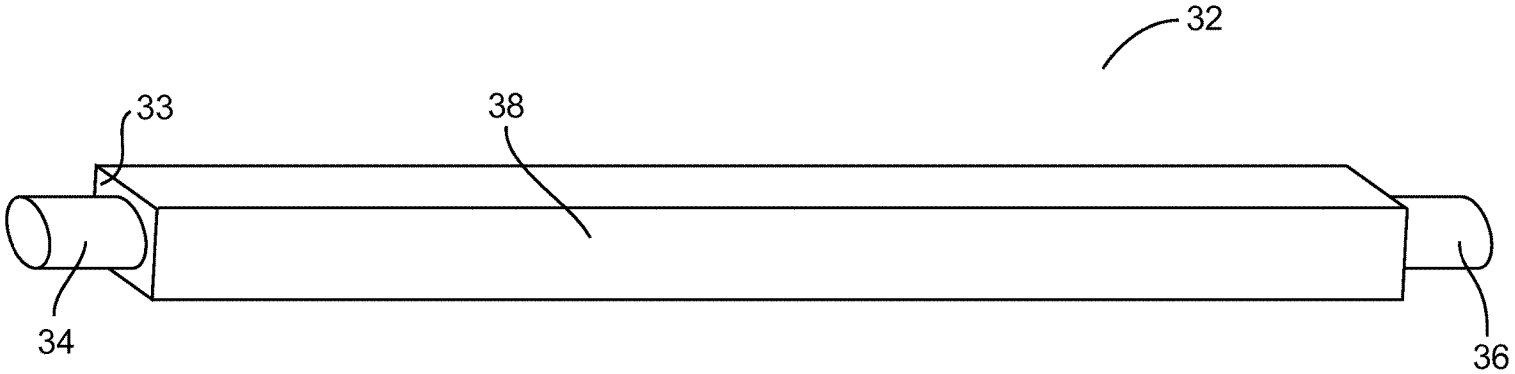
FIG. 8 is a perspective view of a shaft of a shaft assembly for a mechanical bucket.

The shaft 32, as shown in FIG. 8, includes a first end 34 having a circular shape and an opposing second end 36 having a circular shape. A mounting portion 38 of the shaft 32 is configured to couple to the plurality of agitating discs 40, the plurality of first spacer discs 50 and the plurality of second spacer discs 60. The plurality of agitating discs 40 may be slid onto the shaft 32 in a timed configuration. For example and without limitation, an agitating disc 40 with a tooth 44 may be rotated a predetermine number of degrees, such as 90 degrees from the preceding agitating disc 40 with a tooth 44, wherein the teeth 44 of the agitating discs 40 along a length of the shaft form a helical shape. Other timing configurations may be utilized based on the type of agitating disc 40 being used.

Figure 11:
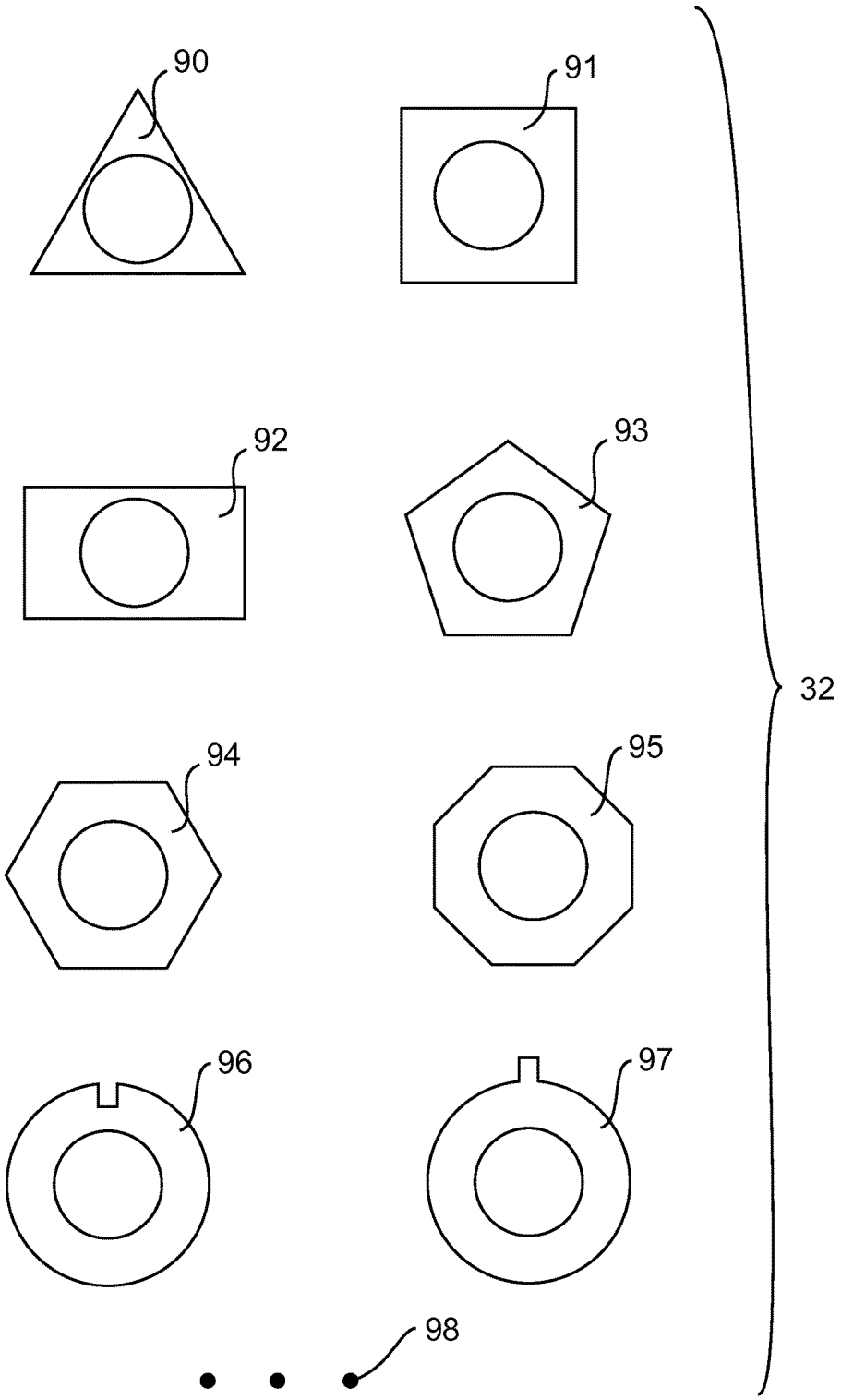
FIG. 11 are end views of configurations of a mounting portion of a shaft of a shaft assembly.

According to embodiments, the mounting portion 38 may be formed in various types of shapes as shown in FIG. 11. For example, and without limitation, the shaft 38 may have a cross-sectional shape of a triangle 90, a square 91, a rectangle 92, a pentagon 93, a hexagon 94, an octagon 95, a circle with a channel 96, a circle with a protrusion 97, or any other shape 98 that allows for proper timing the agitating discs 40. It will be understood that apertures of the various discs will correspond to the shape of the mounting portion 38. This allows for the discs to be slid onto the mounting portion 38 properly prior to coupling end discs to the shaft 32. Particularly, the aperture 42 of the agitating disc 40 can be oriented properly in order to provide for the proper timing of the agitating disc 40 for proper function of the shaft assembly 30.

In embodiments, an end of the mounting portion 38 adjacent the first end 34 of the shat 32 comprises a faced surface 33. The faced surface 33 provides for a square, flat surface from which to align the discs of the shaft assembly 30. In embodiments, a starter disc 70 is coupled to the shaft 32, such that a surface 72 of the starter disc 70 is aligned with the faced surface 33 of the shaft 32. This starter disc 72 then operates to ensure the all remaining discs are aligned properly on the shaft 32. The agitating discs 40, first spacer discs 50 and second spacer discs 60 are then slid axially onto the shaft 32 in a repeating disc order. For example, and without limitation, the disc order may be agitating disc—first spacer disc—second spacer disc—first spacer disc, as shown in FIG. 4.

Once the discs are slid onto the shaft 32, the last disc on the shaft may then be coupled to the shaft 32 after the plurality of agitating discs 40, the plurality of first spacer discs 50 and the plurality of second spacer discs 60 are compressed together on the shaft 32 in an axial direction.

The components defining any shaft assembly 30 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Figure 10:
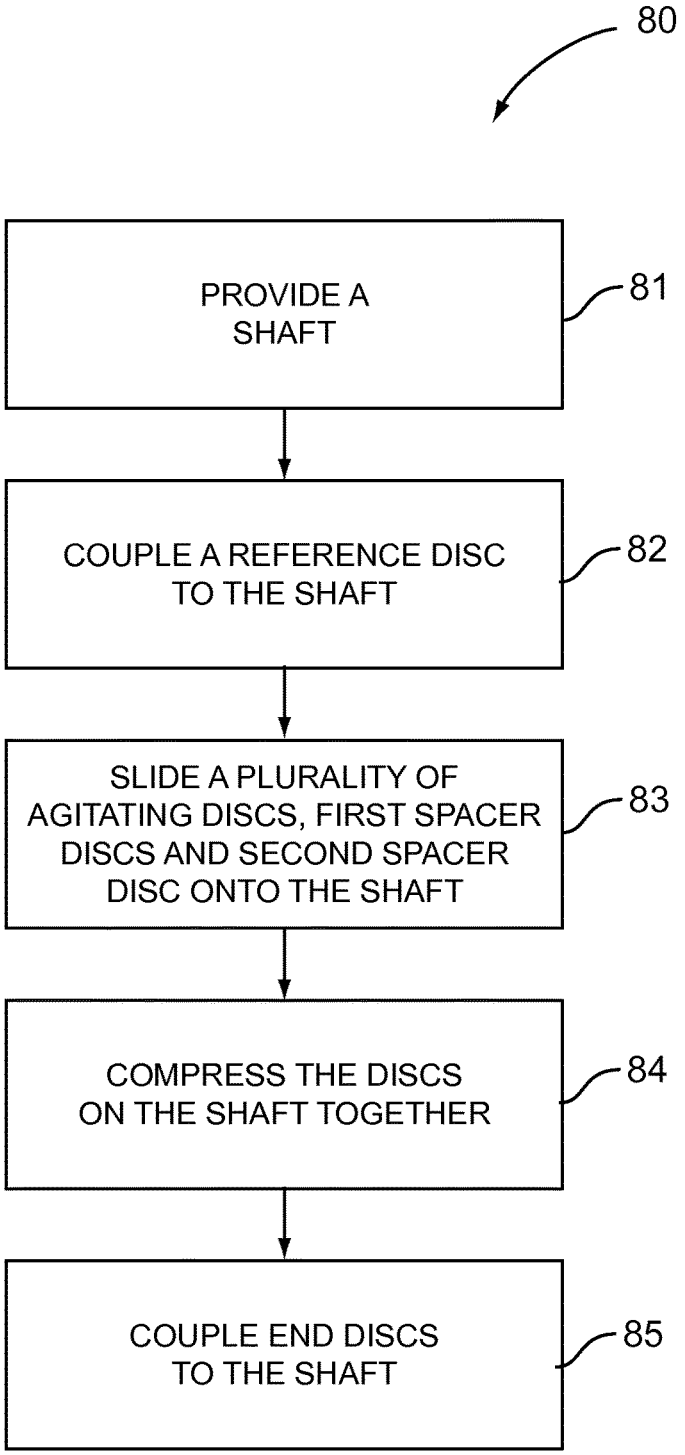
FIG. 10 is a flow chart of a method of forming a shaft for a mechanical bucket.

Referring further to the drawings, FIG. 10 depicts a method 80 of forming a shaft assembly, according to embodiments. The method 80 comprises providing a shaft 32 with a first end having a circular shape and an opposing second end 36 having a circular shape and a mounting portion between the first end and second end (Step 81); coupling a reference disc to the mounting portion of the shaft adjacent the first end (Step 82); sliding a plurality of agitating discs, first spacer discs and second spacer discs onto the shaft in a repeating disc order (Step 83); compressing the discs on the shaft together (Step 84); and coupling end disc, the end disc being the disc closest to the second end of the shaft, to the shaft while the discs are compressed together (Step 85).

The method 80 may further include facing an end of the mounting portion adjacent the first end, wherein the faced end of the mounting portion functions as a reference for aligning the reference disc.

The method 80 also comprises heating the shaft and disc to be coupled to the shaft prior to coupling the disc to the shaft. Further, coupling the reference disc and the end disc to the shaft comprises welding the discs to the shaft.

The method 80 may further comprise uncoupling the reference disc and the end disc and removing all discs from the shaft when the agitating discs are worn. Further the method 80 may include reusing the shaft after removing all discs from the shaft.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A shaft assembly for use with a mechanical bucket, the shaft assembly comprising:

a shaft having a first end and an opposing second end and a mounting portion extending between the first end and the second end;

a plurality of agitating discs, each agitating disc having an aperture corresponding to the mounting portion of the shaft and each agitating disc comprising a tooth;

a plurality of first spacer discs, each first spacer disc having an aperture corresponding to the mounting portion of the shaft; and a plurality of second spacer discs, each second spacer disc having an aperture corresponding to the mounting portion of the shaft, wherein:

the plurality of agitating discs, the plurality of first spacer discs and the plurality of second spacer discs slid onto the shaft in a repeating disc order with the apertures engaging the mounting portion of the shaft and the discs compressed together; and the disc closest to the first end of the shaft and the disc closest to the second end of the shaft are coupled to the shaft, wherein the shaft comprises a faced surface, wherein the faced surface provides a square, flat surface from which to align the discs of the shaft assembly.

2. The shaft assembly of claim 1, wherein the first disc on the shaft is aligned with the faced surface and coupled to the shaft.

3. The shaft assembly of claim 1, wherein the plurality of agitating discs is slid onto the shaft in a timed arrangement.

4. The shaft assembly of claim 1, wherein the plurality of agitating discs, the plurality of first spacer discs and the plurality of second spacer discs are removable from the shaft.

5. The shaft assembly of claim 4, wherein the shaft is reusable.

6. The shaft assembly of claim 4, wherein the plurality of first spacer discs and the plurality of second spacer discs are reusable.

7. A shaft assembly for use with a mechanical bucket, the shaft assembly comprising:

a shaft having a first end and an opposing second end and a mounting portion extending between the first end and the second end;

a plurality of agitating discs, each agitating disc having an aperture corresponding to the mounting portion of the shaft and each agitating disc comprising a tooth;

a plurality of spacer discs, each spacer disc having an aperture corresponding to the mounting portion of the shaft;

a reference disc having an aperture corresponding to the mounting portion of the shaft, wherein the reference disc is slid onto the shaft and located adjacent the first end of the shaft; and an end disc having an aperture corresponding to the mounting portion of the shaft, wherein the reference disc is slid onto the shaft and located adjacent the first end of the shaft, wherein:

the plurality of agitating discs and the plurality of spacer discs are slid onto the shaft in a repeating disc order with the apertures engaging mounting portion of the shaft and the discs compressed together between the reference disc and the end disc in an axial direction to form a screening spaces; and the reference disc and the end disc are the only discs removably secured to the shaft, wherein the reference disc is removably secured to the shaft such that a surface of the reference disc is square to the shaft and the reference disc is aligns the plurality of agitating discs and plurality of spacer discs along the shaft and wherein the shaft comprises a faced surface, wherein the faced surface provides a square, flat surface from which to align the reference disc.

8. The shaft assembly of claim 7, wherein the plurality of agitating discs is slid onto the shaft in a timed arrangement.

9. The shaft assembly of claim 7, wherein the plurality of spacer discs is a plurality of first spacer discs and a plurality of second spacer discs.

10. The shaft assembly of claim 7, wherein the plurality of agitating discs and the plurality of spacer discs is a plurality of agitating discs with integral spacer members.

11. The shaft assembly of claim 7, wherein the plurality of agitating discs and the plurality of spacer discs are removable from the shaft.

12. The shaft assembly of claim 7, wherein the shaft is reusable.

13. The shaft assembly of claim 7, wherein the plurality of spacer discs is reusable.

* * * * *